US008418717B2

(12) United States Patent
Pruthi et al.

(10) Patent No.: US 8,418,717 B2
(45) Date of Patent: Apr. 16, 2013

(54) EXHAUST PLENUM FLOW SPLITTER

(75) Inventors: Rohit Pruthi, Karnataka (IN); Deepesh Dinesh Nanda, Karnataka (IN)

(73) Assignee: General Electric Company, Schenectady, NY (US)

( * ) Notice: Subject to any disclaimer, the term of this patent is extended or adjusted under 35 U.S.C. 154(b) by 199 days.

(21) Appl. No.: 12/841,668

(22) Filed: Jul. 22, 2010

(65) Prior Publication Data

US 2012/0018015 A1 Jan. 26, 2012

(51) Int. Cl.
*F15D 1/04* (2006.01)
*F03B 11/00* (2006.01)

(52) U.S. Cl.
USPC ..... 137/561 A; 137/561 R; 138/39

(58) Field of Classification Search ..... 137/561 A, 137/561 R, 574; 251/118, 127; 138/39; 60/324; 454/237, 241, 246, 247, 278
See application file for complete search history.

(56) References Cited

U.S. PATENT DOCUMENTS

| | | | | |
|---|---|---|---|---|
| 2,565,674 | A * | 8/1951 | Zachlin | 429/82 |
| 3,470,914 | A * | 10/1969 | Smith | 138/39 |
| 3,864,938 | A * | 2/1975 | Hayes, Jr. | 62/504 |
| 4,254,512 | A * | 3/1981 | Soderstrom | 4/679 |
| 4,512,368 | A * | 4/1985 | Kaminaka et al. | 137/561 A |
| 5,503,182 | A * | 4/1996 | Huang | 137/484.8 |
| 6,435,216 | B2 * | 8/2002 | McCulloch | 138/42 |
| 6,805,539 | B2 * | 10/2004 | Schubert | 417/313 |
| 6,880,566 | B2 * | 4/2005 | Newman | 137/377 |
| 7,549,442 | B2 * | 6/2009 | Jones | 137/565.37 |
| 2006/0207672 | A1 * | 9/2006 | Henriksson et al. | 138/37 |
| 2009/0152308 | A1 * | 6/2009 | Drambarean | 222/590 |
| 2009/0288388 | A1 | 11/2009 | Bies et al. | |
| 2010/0230508 | A1 * | 9/2010 | Petrovich | 239/14.1 |
| 2011/0067174 | A1 * | 3/2011 | Schafer et al. | 4/679 |

* cited by examiner

*Primary Examiner* — Craig Schneider
*Assistant Examiner* — Jonathan Waddy
(74) *Attorney, Agent, or Firm* — Cantor Colburn LLP

(57) ABSTRACT

An apparatus is provided and includes a plenum into which a fluid is exhausted, the plenum including a wall toward which the exhausted fluid is directed, the wall including first sections, second sections interposed between the first sections and a flow splitter interposed between the second sections, and a plane of the second sections being recessed from a plane of the first sections and the flow splitter protruding from the plane of the second sections.

15 Claims, 4 Drawing Sheets

EXHAUST PLENUM FLOW SPLITTER

BACKGROUND OF THE INVENTION

The subject matter disclosed herein relates to exhaust diffusion with an exhaust plenum flow splitter.

A quality of aerodynamic performance of an exhaust diffuser is at least partially functionally related to an amount of exit loss exhibited by the exhaust diffuser as fluid flowing through the exhaust diffuser enters an exhaust plenum from a diffuser exit. Where the exhaust plenum is relatively large, these exit losses tend to increase and aerodynamic performance tends to decrease.

It is, therefore, useful to maintain a relatively small size of the exhaust plenum space for cost and material gains. As a result of this reduction of space, however, a back pressure may develop that leads to flow reversal at the diffuser exit and may lead to other types of potential performance losses besides those described above. In particular, recirculation caused by flow reversal may percolate downstream from the plenum and subsequently balloon to thereby reduce an effective flow area through which the fluid can proceed and thus hinder diffusion.

BRIEF DESCRIPTION OF THE INVENTION

According to one aspect of the invention, an apparatus is provided and includes a plenum into which a fluid is exhausted, the plenum including a wall toward which the exhausted fluid is directed, the wall including first sections, second sections interposed between the first sections and a flow splitter interposed between the second sections, and a plane of the second sections being recessed from a plane of the first sections and the flow splitter protruding from the plane of the second sections.

According to another aspect of the invention, an apparatus is provided and includes a diffuser through which fluid flows and a plenum fluidly coupled to the diffuser into which the fluid is exhausted from the diffuser, the plenum including a wall toward which the exhausted fluid is directed, the wall including first sections, second sections interposed between the first sections and a flow splitter interposed between the second sections, and a plane of the second sections being recessed from a plane of the first sections and the flow splitter protruding from the plane of the second sections.

According to yet another aspect of the invention, an apparatus is provided and includes a diffuser including a peripheral wall defining a flow path along which fluid flows toward a diffuser exit and a plenum fluidly coupled to the diffuser into which the fluid is exhausted from the diffuser exit, the plenum including a wall toward which the exhausted fluid is directed, the wall including first sections, second sections interposed between the first sections and a flow splitter interposed between the second sections, and a plane of the second sections being recessed from a plane of the first sections and the flow splitter protruding from the plane of the second sections toward the plane of the first sections.

These and other advantages and features will become more apparent from the following description taken in conjunction with the drawings.

BRIEF DESCRIPTION OF THE DRAWING

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
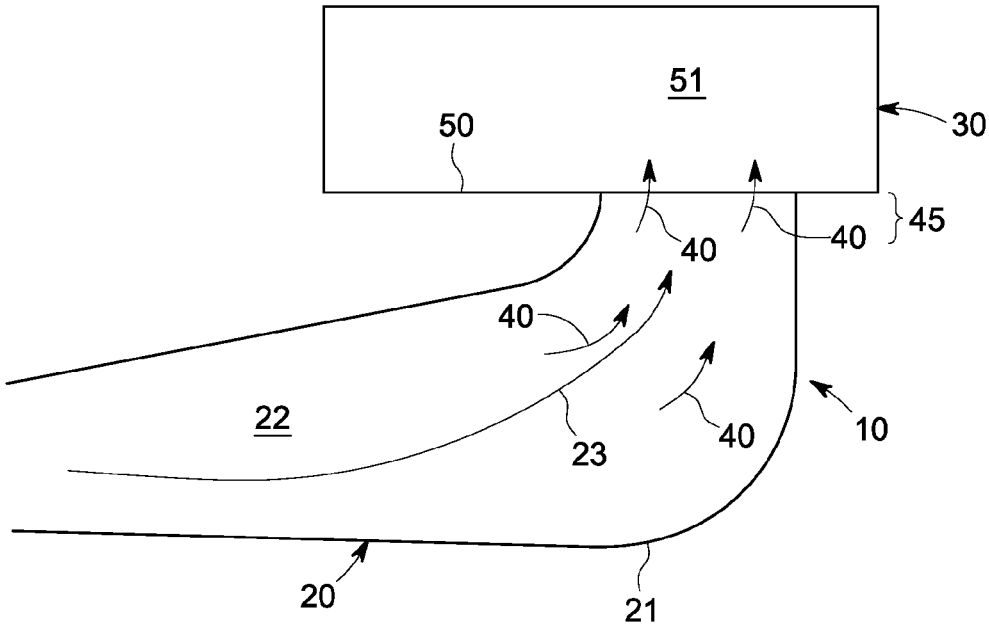
FIG. 1 is a schematic view of an exhaust diffuser and an exhaust plenum.

With reference to FIG. 1, an apparatus 10 is provided and includes an exhaust diffuser 20 (hereinafter referred to as a "diffuser 20") and an exhaust plenum 30 (hereinafter referred to as a plenum 30). The diffuser 20 includes a peripheral wall 21 defining a diffuser interior 22 through which a flow path 23 extends. Fluid 40 flows along the flow path 23 toward diffuser exit 45 defined proximate to the plenum 30. The plenum 30 is fluidly coupled to the diffuser 20 at a location that is proximate to the diffuser exit 45 and includes a plenum wall 50 that is formed to define a plenum interior 51, which is receptive of the fluid 40 being exhausted from the diffuser exit 45.

Figure 2:
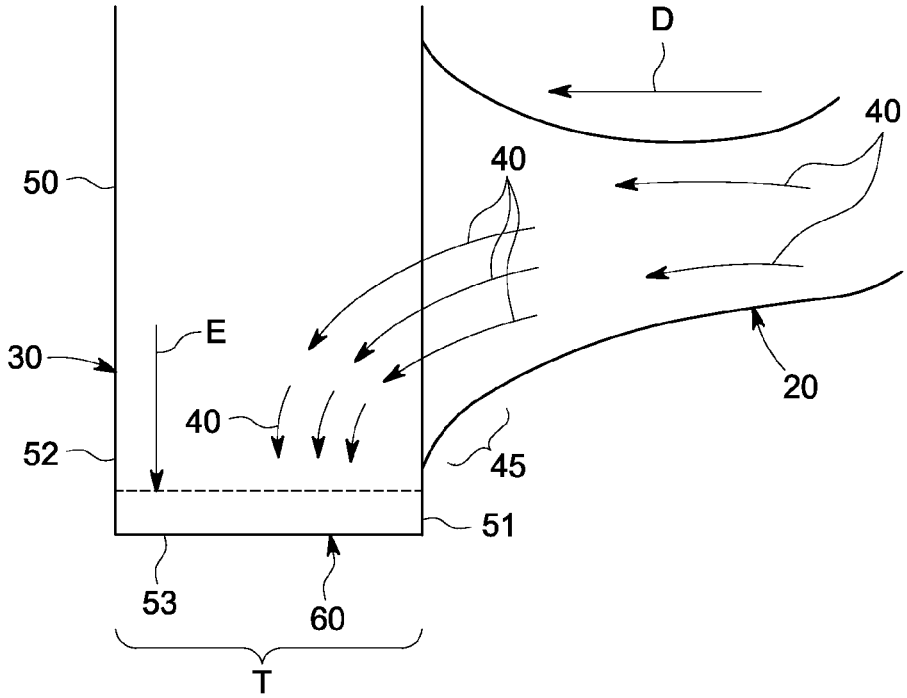
FIG. 2 is a side view of the exhaust diffuser and the exhaust plenum of FIG. 1.
Figure 3:
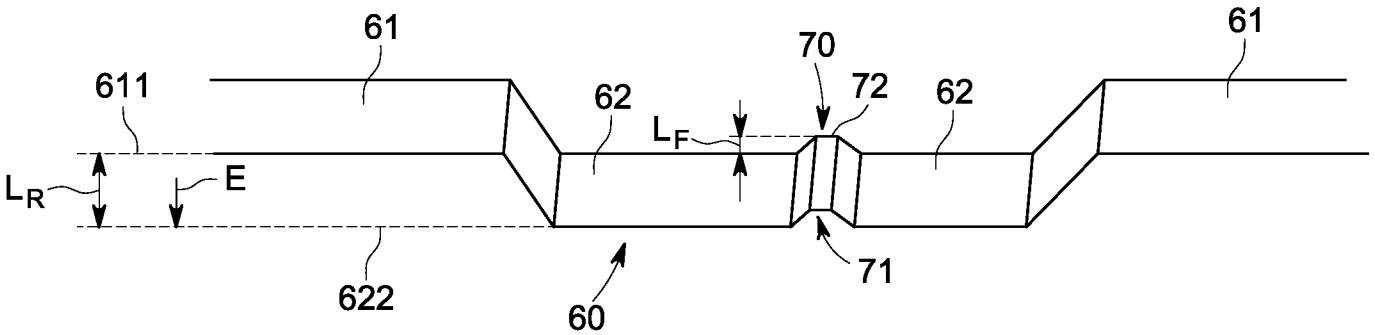
FIG. 3 is an enlarged perspective view of a wall of the exhaust plenum.
Figure 4:
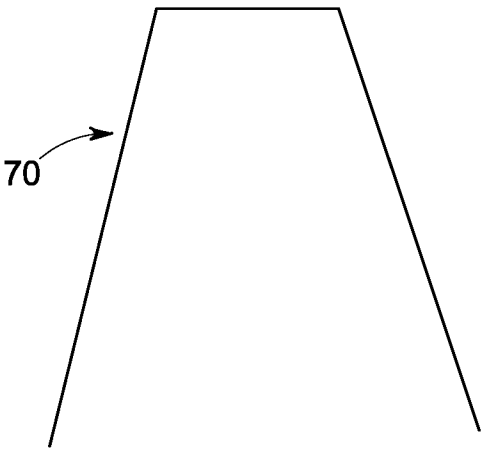

With reference to FIGS. 2, 3 and 4, the plenum wall 50 includes first and second opposing walls 51 and 52, with the diffuser 20 being fluidly coupled to the first opposing wall 51, and an intermediate wall 53 extending between the first and second opposing walls 51 and 52. The intermediate wall 53 includes wall section 60 toward which the exhausted fluid 40 is directed upon exiting the diffuser 20. The wall section 60 includes first sections 61, second sections 62 interposed between the first sections 61 and a flow splitter 70 interposed between the second sections 62. A second section plane 622 of the second sections 62 is recessed from a first section plane 611 of the first sections 61 and the flow splitter 70 protrudes from the second section plane 622 toward the first section plane 611.

As shown in FIGS. 2, 3 and 4, the wall section 60 includes a bottom-most portion of the intermediate wall 53 relative to a gravitation direction which may be similar in orientation to a partial exhaust direction, E, of the exhausted fluid 40. The second section plane 622 is recessed from the first section plane 611 in the exhaust direction, E, and the flow splitter 70 protrudes from the second section plane 622 toward the first section plane 611 in a direction opposite to the exhaust direction, E. The flow splitter 70 may include a flow splitter body 71 and may have a height length, $L_F$, which is generally shorter than a depth length of the recess, $L_R$, such that an uppermost tip 72 of the flow splitter 70 is recessed from the first section plane 611 in the exhaust direction, E.

With the configuration described above, the flow splitter 70 may include a radial extension of the wall section 60 that extends toward the diffuser 20. The flow splitter 70 may be integrally connected to the wall section 60 or otherwise disposed at the wall section 60 at a predefined position between the second sections 62. The flow splitter 70 may be formed as a single component or multiple components and may span a thickness, T, of the wall section 60 as defined from the first opposing wall 51 to the second opposing wall 52.

Figure 5:
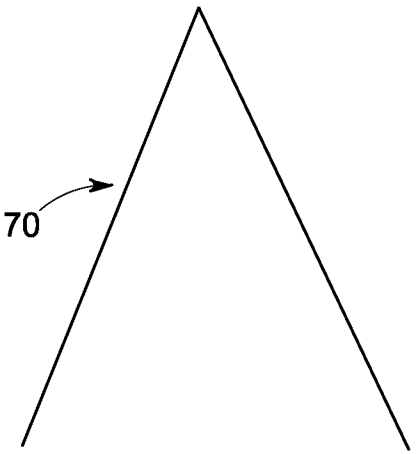
FIGS. 4-7 are cross-sectional views of a flow splitter.
Figure 7:
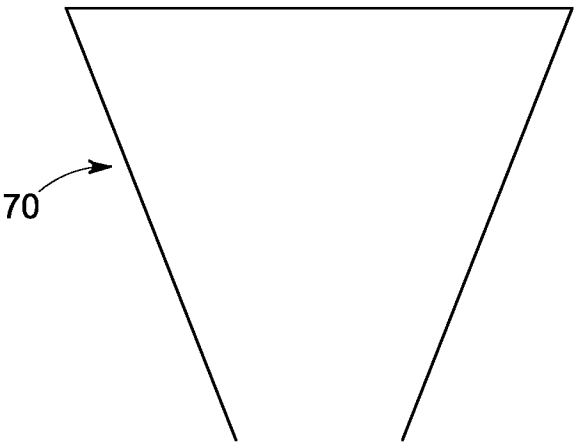
Figure 6:
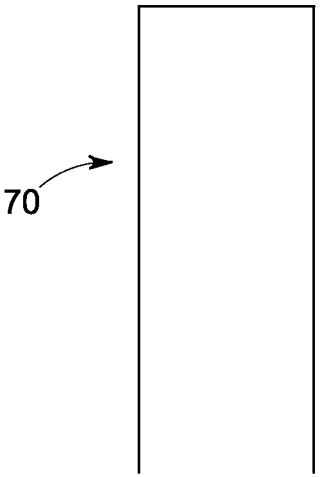

With reference to FIGS. 4-7, the flow splitter 70 may have various cross-sectional shapes including, but not limited to, a frusto-conical shape as in FIG. 4, a conical or pointed shape as in FIG. 5, a rectangular or square shape as in FIG. 6 and/or a trapezoidal shape as in FIG. 7.

Figure 8:
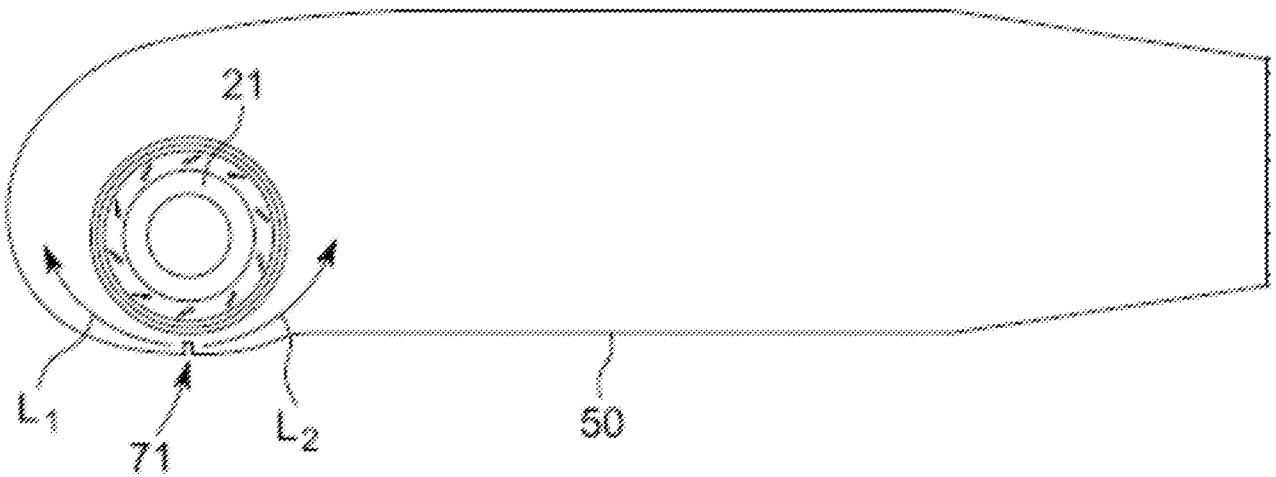
FIG. 8 is a plan view of the fluid volume constrained within an exit of the exhaust diffuser and the exhaust plenum.

With reference to FIGS. 2 and 8, a longitudinal axis of the flow splitter 70 may be oriented to be substantially parallel with a predominant direction, D, of fluid flow through the diffuser 20. Here, a cross-section of the flow splitter 70 is shown as having a rectangular shape but, in accordance with FIGS. 4-7, the cross-section of the flow splitter may have a frusto-conical shape, a substantially conical or pointed shape, a trapezoidal shape and/or other similar shapes. In this way, the flow splitter 70 directs the exhausted fluid 40 to flow in lateral directions, $L_1$ and $L_2$, which are oriented substantially transversely with respect to the predominant direction, D, of the fluid flow through the diffuser 20.

As such, the flow splitter 70 substantially prevents fluid 40 flow reversal by directing flow to recirculate near the flow splitter 70. This relatively localized recirculation leads to a development of a false wall that may enhance a diffusing passage.

In accordance with still further embodiments of the invention, it is to be understood that the flow splitter 70 need not be positioned on or coupled to the intermediate wall 53. In fact, the flow splitter 70 may be positioned on or coupled to either of the first opposing wall 51 or the second opposing wall 52 alone or in combination with a further coupling to another one or more of the walls. It is further to be understood that the exhausted fluid 40 is at least partially exhausted toward the first and the second opposing walls 51 and 52 as well.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An apparatus, comprising:

a plenum into which a fluid is exhausted, the plenum including opposing walls and an intermediate wall extending between the opposing walls, the intermediate wall including a wall section toward which the exhausted fluid is directed, the wall section comprising a bottom-most wall of the plenum relative to a gravitational direction and including first sections, second sections interposed between the first sections and a flow splitter interposed between the second sections, and a plane of the second sections being recessed with respect to the gravitational direction from a plane of the first sections and the flow splitter extending from one of the opposing walls to the other of the opposing walls to thereby span the intermediate wall and protruding from the plane of the second sections.

2. The apparatus according to claim 1, wherein the plane of the second sections is recessed from the plane of the first sections in an exhaust direction of the exhausted fluid, the flow splitter protrudes from the plane of the second sections toward the plane of the first sections and an uppermost tip of the flow splitter is recessed from the plane of the first sections in the exhaust direction.

3. The apparatus according to claim 1, wherein the flow splitter is integrally connected to the intermediate wall.

4. The apparatus according to claim 1, wherein the flow splitter is disposed at a predefined position of the intermediate wall between the second sections.

5. The apparatus according to claim 1, wherein a cross-section of the flow splitter has any one of a frusto-conical shape, a conical or pointed shape, a rectangular or square shape and a trapezoidal shape.

6. An apparatus, comprising:

a diffuser through which fluid flows; and a plenum fluidly coupled to the diffuser into which the fluid is exhausted from the diffuser, the plenum including opposing walls and an intermediate wall extending between the opposing walls, the intermediate wall including a wall section toward which the exhausted fluid is directed, the wall section comprising a bottom-most wall of the plenum relative to a gravitational direction and including first sections, second sections interposed between the first sections and a flow splitter interposed between the second sections, and a plane of the second sections being recessed with respect to the gravitational direction from a plane of the first sections, and the flow splitter being elongated in a direction substantially parallel with a predominant direction of fluid flow through the diffuser, extending from one of the opposing walls to the other of the opposing walls to thereby span an entire thickness of the intermediate wall and protruding from the plane of the second sections.

7. The apparatus according to claim 6, wherein the plane of the second sections is recessed from the plane of the first sections in an exhaust direction of the exhausted fluid, the flow splitter protrudes from the plane of the second sections toward the plane of the first sections and an uppermost tip of the flow splitter is recessed from the plane of the first sections in the exhaust direction.

8. The apparatus according to claim 6, wherein the flow splitter comprises a radial extension of the intermediate wall toward the diffuser.

9. The apparatus according to claim 6, wherein the flow splitter is integrally connected to the intermediate wall.

10. The apparatus according to claim 6, wherein a longitudinal axis of the flow splitter is substantially parallel with a predominant direction of fluid flow through the diffuser.

11. The apparatus according to claim 6, wherein a cross-section of the flow splitter has any one of a frusto-conical shape, a conical or pointed shape, a rectangular or square shape and a trapezoidal shape.

12. The apparatus according to claim 6, wherein the flow splitter directs the exhausted fluid to flow in lateral directions oriented transversely to a predominant direction of fluid flow through the diffuser.

13. An apparatus, comprising:

a diffuser including a peripheral wall defining a flow path along which fluid flows toward a diffuser exit; and a plenum fluidly coupled to the diffuser into which the fluid is exhausted from the diffuser exit, the plenum including opposing walls and an intermediate wall extending between the opposing walls, the intermediate wall including a wall section toward which the exhausted fluid is directed, the wall section comprising a bottom-most wall of the plenum relative to a gravitational direction and including first sections, second sections interposed between the first sections and a flow splitter interposed between the second sections, and a plane of the second sections being recessed with respect to the gravitational direction from a plane of the first sections, and the flow splitter being elongated in a direction substantially parallel with a predominant direction of fluid flow through the diffuser, extending from one of the opposing walls to the other of the opposing walls to thereby span an entire thickness of the intermediate wall and protruding from the plane of the second sections.

14. The apparatus according to claim 13, wherein a cross-section of the flow splitter has any one of a frusto-conical shape, a conical or pointed shape, a rectangular or square shape and a trapezoidal shape.

15. The apparatus according to claim 13, wherein the flow splitter directs the exhausted fluid to flow in lateral directions oriented transversely to a predominant direction of fluid flow through the diffuser.

* * * * *